US005419069A

United States Patent [19]

Mumbleau et al.

[11] Patent Number: 5,419,069

[45] Date of Patent: May 30, 1995

[54] FIREARM LOCKING MECHANISM

[75] Inventors: Dean W. Mumbleau, Becker; Craig T. Mumbleau, Brooklyn Park, both of Minn.

[73] Assignee: Mag-Lok, Inc., St. Cloud, Minn.

[21] Appl. No.: 274,979

[22] Filed: Jul. 14, 1994

[51] Int. Cl.[6] ..... F41A 17/02; F41A 17/32; F41A 17/38

[52] U.S. Cl. ..... 42/70.11

[58] Field of Search ..... 42/70.11

[56] References Cited

U.S. PATENT DOCUMENTS

| | | | |
|---|---|---|---|
| 3,089,272 | 5/1963 | McKinlay | 42/1 |
| 3,634,963 | 1/1972 | Hermann | 42/1 N |
| 3,673,725 | 7/1972 | Cravener | 42/1 R |
| 3,882,622 | 5/1975 | Perlotto | 42/1 LP |
| 4,014,123 | 3/1977 | Williams | 42/1 LP |
| 4,136,475 | 1/1979 | Centille | 42/1 LP |
| 4,266,356 | 5/1981 | Jarvinen | 42/1 LP |
| 4,384,420 | 5/1983 | Von Muller | 42/1 LP |
| 4,532,029 | 8/1985 | Von Muller | 42/1 LP |
| 4,654,992 | 4/1987 | Lavergne | 42/70.11 |
| 4,672,762 | 6/1987 | Nilsson | 42/70.01 |
| 4,709,496 | 12/1987 | Johnson | 42/70.11 |
| 4,763,431 | 8/1988 | Allan et al. | 42/70.11 |
| 4,835,894 | 6/1989 | Libassi | 42/70.11 |
| 4,987,693 | 1/1991 | Brooks | 42/70.11 |
| 5,090,148 | 2/1992 | Brooks | 42/70.11 |
| 5,140,766 | 8/1992 | Brooks | 42/70.11 |
| 5,231,236 | 7/1993 | Del Rael et al. | 42/70.11 |
| 5,241,769 | 9/1993 | Von Muller | 42/70.11 |
| 5,331,759 | 7/1994 | Marceau et al. | 42/70.11 |

*Primary Examiner*—Charles T. Jordan
*Assistant Examiner*—Theresa M. Wesson
*Attorney, Agent, or Firm*—Philip G. Alden; Craig M. Gregersen; Briggs and Morgan

[57] ABSTRACT

A firearm locking mechanism comprising block or body having a conventional pin-tumbler or cylindrical lock mounted generally vertically therein. The block or body is received within the exposed area between the breech and open breech block in a firearm directly above the magazine, with an engagement member connected to the bottom of the lock being received within the top of the magazine and rotated by the lock. The engagement member engages beneath and between the cartridge-retaining surfaces at the top of the magazine to secure the lock and body to the top of the magazine, thereby preventing the breech block from closing or the magazine from being removed. The locking mechanism similarly prevents moving the firing pin assembly into proximity with any cartridge remaining in the barrel or magazine.

10 Claims, 3 Drawing Sheets

FIREARM LOCKING MECHANISM

BACKGROUND OF TIIE INVENTION

1. Field of the Invention

This invention relates generally to devices for preventing the accidental or unintentional discharge of a firearm, and particularly to an active locking mechanism that may be installed on handguns, rifles, or other firearms having a clip or magazine and an exposed breech area.

2. Prior Art

Various types of active locking mechanisms for firearms are known. These mechanisms include: (1) bore locks which require the insertion of a lockable bar through the bore or barrel of the firearm, (2) trigger guard locks that enclose the trigger guard area to prevent insertion of a finger or block rearward movement of the trigger itself, and (3) frame-mounted locks which integrate an active locking mechanism into one or more operations of the firearm, such as the manual safety, hammer drawback or drop, or magazine insertion.

Representative examples of various frame-mounted active locking mechanisms are shown in U.S. Pat. Nos. 3,673,725 to Cravener; U.S. Pat. No. 3,882,622 to Perlotto; U.S. Pat. No. 4,014,123 to Williams; U.S. Pat. No. 4,136,475 to Centille; U.S. Pat. No. 4,384,420 to Von Muller; U.S. Pat. No. 4,763,431 to Allan; and U.S. Pat. Nos. 5,140,766; 5,090,148; and 4,987,693 to Brooks.

The art relating to bore locks includes various breech locks and breech stops designed for insertion into the breech of a firearm, usually with a retractable pin or plug projecting forwardly into the breech end of the barrel and sometimes rearwardly to engage the breech block, frame, or slide. Representative examples of various in bore and breech blocking locking mechanisms are shown in U.S. Pat. No. 3,089,272 to McKinlay; U.S. Pat. No. 3,634,963 to Hermann; U.S. Pat. No. 4,266,356 to Järvinen; U.S. Pat. No. 4,672,762 to Nilsson; U.S. Pat. No. 4,709,496 to Johnson; U.S. Pat. No. 5,231,236 to Del Real; and U.S. Pat. No. 4,835,894 to Libassi.

The field of frame-mounted locks include various locking mechanisms that interact with both the frame and magazine of the firearm to hold the magazine in place while the lock is engaged and to prevent loading or discharging the firearm. These locking mechanisms may also include a magazine plug that obstructs the loading or passage of ammunition through or from a tubular, stacked, or drum magazine. Representative examples of various in magazine locking mechanisms are shown in U.S. Pat. Nos. 4,532,729 and 5,241,769 to Von Muller.

Each of the locking mechanisms described above is relatively complicated, expensive to manufacture, or requires modification of the firearm in order to install or to incorporate the locking mechanism into the frame or magazine of the firearm.

BRIEF SUMMARY OF THE INVENTION

It is therefore one object of this invention to design a locking mechanism for firearms such as semi-automatic pistols which may be incorporated into existing firearm designs without modification of the frames, slide assemblies, or other functional elements of the firearm associated with the chambering mechanisms, firing mechanisms, or ejector mechanisms.

It is a related object of this invention to design the above locking mechanism such that it is exceedingly inexpensive to manufacture, simple to install, may be adapted to a wide variety of firearms, and provides complete security against accidental or unintentional discharge of a loaded or unloaded firearm.

It is a distinct object of this invention to design the above locking mechanism such that it may be used to store a semi-automatic pistol having a loaded magazine and yet permits the safe and rapid removal of the locking mechanism in the event the firearm is needed for self-defense or a similar emergency.

It is a related object of this invention to design the above locking mechanism such that it actually facilitates or encourages its own removal from a semi-automatic pistol having a loaded magazine once the locking mechanism is unlocked and further assists the user so as to prevent mishandling or delays in unlocking the locking mechanism.

It is a yet another object of this invention to design the above locking mechanism such that it resists or prevents tampering or circumvention.

Briefly described, the preferred embodiment of the locking mechanism of this invention comprises a block or body having a conventional pin-tumbler or cylindrical lock mounted generally vertically therein. The block or body is received within the exposed area between the breech and open breech block in a firearm directly above the magazine, with an engagement member connected to the bottom of the lock being received within the top of the magazine and rotated by the lock. The engagement member engages beneath and between the cartridge-retaining surfaces at the top of the magazine to secure the lock and body to the top of the magazine, thereby preventing the breech block from closing or the magazine being removed. The locking mechanism similarly prevents moving the firing pin assembly into proximity with any cartridge remaining in the barrel or magazine.

DESCRIPTION OF THE PREFERRED EMBODIMENTS

The firearm locking mechanism of this invention is shown in FIGS. 1–12 and referenced generally therein by the numeral 10.

The firearm locking mechanism 10 is shown for reference and descriptive purposes installed on a semi-automatic pistol 12. Although many types of firearms, handguns, or pistols are suitable for use with or may be modified to accommodate the firearm locking mechanism 10, an Israeli Military Industries/Magnum Research Inc. Desert Eagle 0.357 caliber semi-automatic pistol 12 is shown as a representative example of the manner and best mode contemplated for utilizing the firearm locking mechanism as described herein.

Figure 1:
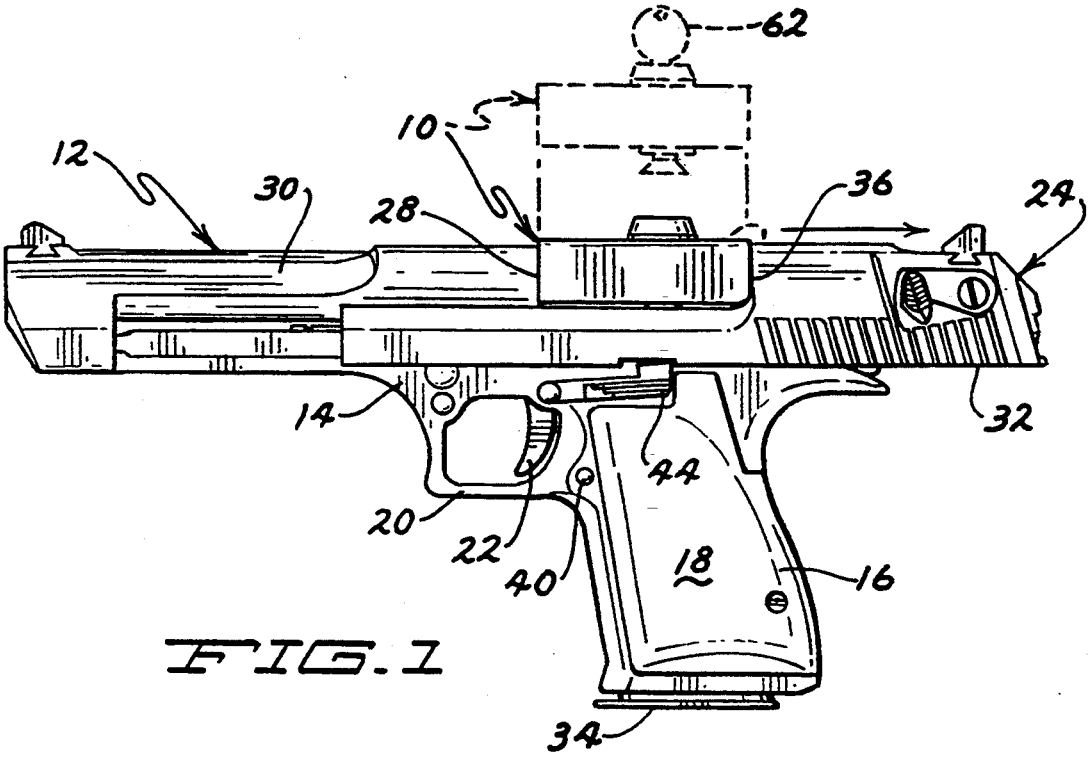
FIG. 1 is a side elevation view of a semi-automatic pistol as further described in the specification incorporating the firearm locking mechanism of this invention.
Figure 2:
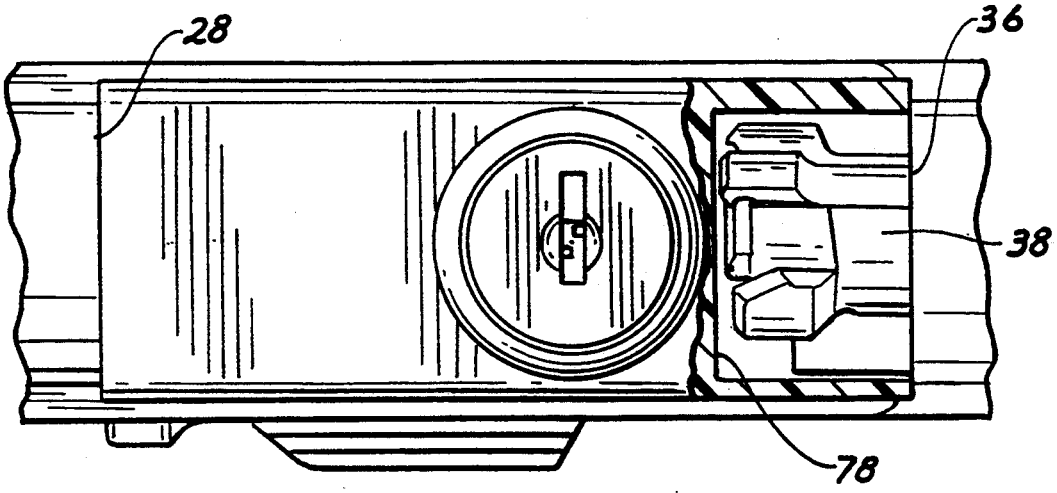
FIG. 2 is a partially broken away detail view of the top rear portion of the semi-automatic pistol of FIG. 1 showing the firearm locking mechanism in the engaged position.
Figure 4:
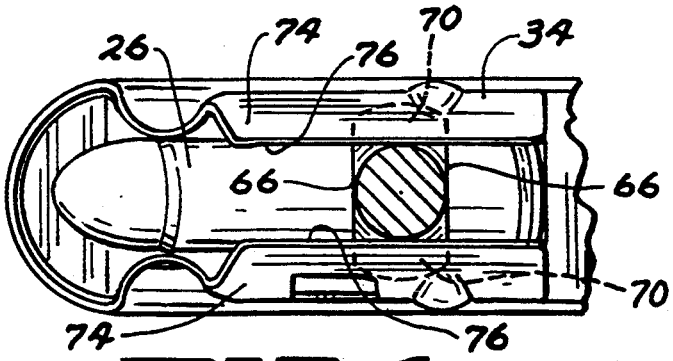
FIG. 4 is a partial cross section view taken through line 4—4 of FIG. 3.
Figure 3:
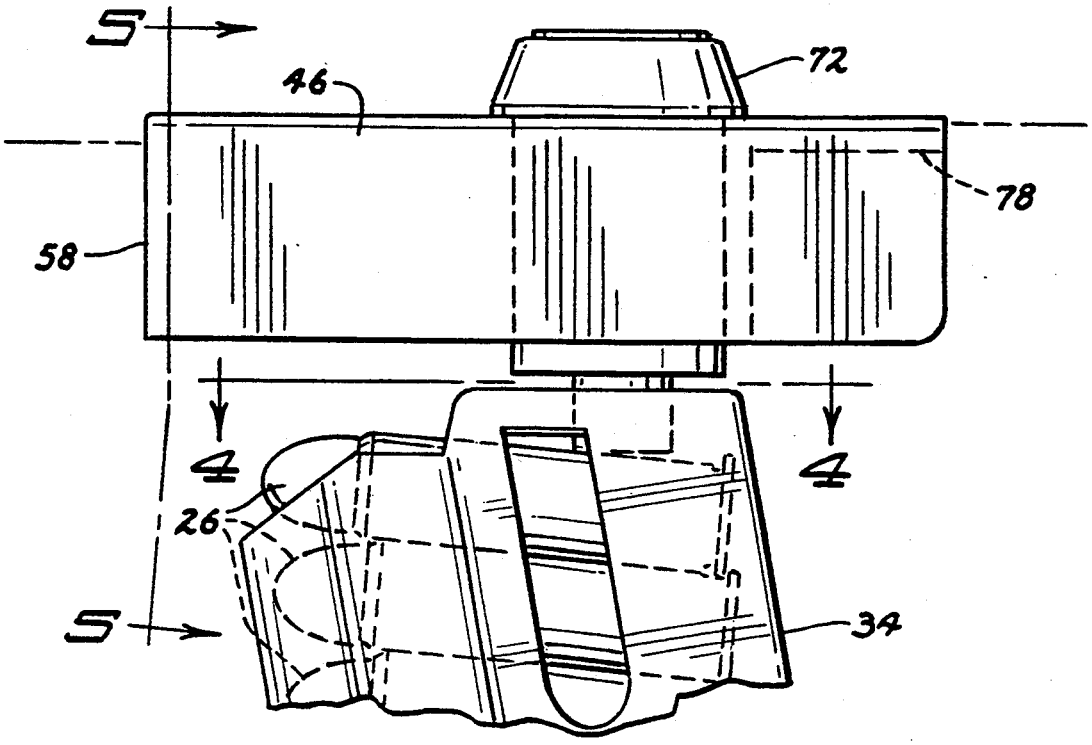
FIG. 3 is a side elevation view of the top of the magazine of the semi-automatic pistol of FIG. 1 showing the firearm locking mechanism mounted thereon in the engaged position.
Figure 5:
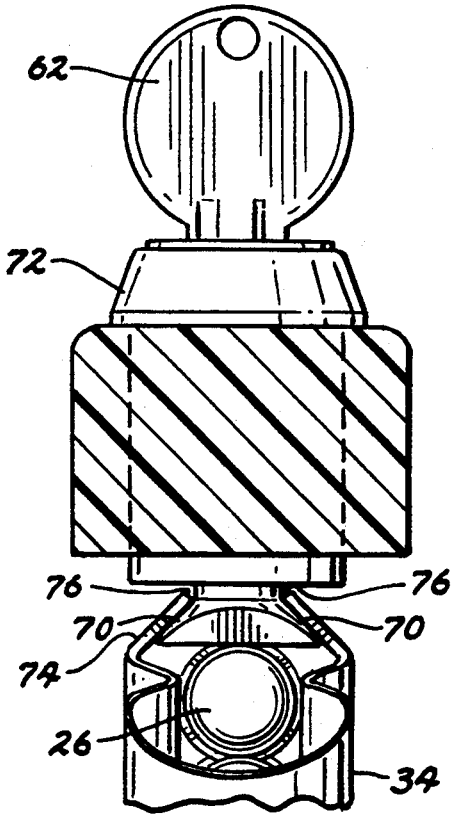
FIG. 5 is a partially broken away cross section view of the top of the magazine and firearm locking mechanism of FIG. 3 taken through line 5—5 of FIG. 3 showing the firearm locking mechanism mounted on the magazine in the engaged position.

Referring particularly to FIGS. 1–4, it may be seen that the semi-automatic pistol 12 includes a frame 14 defining a butt or handgrip region 16 covered on both sides by wood or polymer handgrips 18. The frame 14 defines a trigger guard 20 disposed in front of the handgrip region 16 and protecting a trigger assembly 22 that is pivotally mounted within the frame 14 and movable between a rest position and a firing position. It will be understood by those of skill in the art that the trigger assembly 22 is operatively connected by a series of internal mechanisms (not shown) to a hammer assembly 24 positioned at the rear of the frame 14. The hammer assembly 24 is pivotally mounted within the frame 14 and spring-biased to move between a cocked or ready position and a firing or rest position as shown in FIG. 1 in response to the trigger 22 being retracted completely to the firing position.

The semi-automatic pistol 12 may be fired or discharged in one of two ways. A round or cartridge 26 of ammunition is chambered at or within the rear or breech 28 end of the barrel 30 by retracting the slide assembly 32 rearwardly along the frame 14 and then forwardly to strip the cartridge 26 from the top of the magazine 34 or clip and dispose that cartridge 26 within the enclosed firing chamber at the breech 28 end of the barrel 30. The process of chambering the cartridge 26 also draws the hammer assembly 24 rearwardly to the cocked position, at which point the hammer assembly is caught and held by a sear (not shown) while the slide assembly 32 returns to the normal position with the breech block 36 of the slide assembly 32 contacting the breech 28 end of the barrel 30 and thereby closing the breech 28. The trigger assembly 22 can then be manually retracted (or "squeezed") until the trigger assembly 22 reaches the firing position, at which point the sear releases the hammer assembly 24 and the hammer assembly 24 pivots forward and strikes the firing pin assembly 38. The firing pin assembly 38 is slidably carried within the slide 32 portion of the frame 14 and is spring-biased rearwardly by a compression spring. However, the force of the hammer assembly 24 striking the firing pin assembly 38 is sufficient to overcome the spring force of the compression spring and propel the firing pin 32 forward until the front surface strikes the primer (not shown) in the rear of the round to cause the round to fire. The force of the cartridge discharging serves to propel the cartridge's projectile through the barrel 30 and also drives the slide assembly 32 rearwardly to eject the casing of the spent cartridge 26 from the chamber, strip a second cartridge 26 of ammunition from the top of the magazine 34, cock the hammer assembly 24, and place the semi-automatic pistol 12 in position to fire that second cartridge 26.

Alternately, once the semi-automatic pistol 12 has been cocked by retracting the slide assembly 32 as described above, the semi-automatic pistol 12 may be decocked, thus causing a alecocking mechanism (not shown) to release the sear so that the hammer assembly 24 may be lowered toward the slide assembly 32 and firing pin assembly 38. In some semi-automatic pistols 12, the alecocking mechanism controllably lowers the hammer assembly 24, either fully or to a partially cocked or stopped position that prevents contact between the hammer assembly 24 and firing pin assembly 38, with the hammer assembly 24 being manually dropped to the rest position within the rear of the slide assembly 24 by placing rearward tension on the hammer assembly 24 and retracting the trigger assembly 22 slightly.

From this rest position, the semi-automatic pistol 12 of the double-action type may be fired by manually squeezing or retracting the trigger assembly 22 to draw the hammer assembly 24 rearwardly against the spring tension until the trigger assembly 22 reaches the firing position, at which point the sear releases the hammer assembly 24 and the hammer assembly 24 similarly pivots forward and strikes the firing pin assembly 38 to discharge the cartridge 26 in the chamber or breech 28 end of the barrel 30.

The magazine 34 may be released and withdrawn from the butt or handgrip region 16 of the frame 14 by depressing a spring-biased magazine catch 40 disposed directly behind the trigger guard 20. The magazine 34 can then be slidably removed from within the handgrip region 16, loaded with additional rounds 26 of ammunition, and slidably inserted into its recess within the handgrip region 16 until the magazine catch 40 engages and holds the magazine 34 in position.

Other features and mechanisms of the semi-automatic pistol 12 will be apparent from the description of the structure and operation of the firearm locking mechanism 10 which follows; however, such features and mechanisms are within the basic understanding of one of ordinary skill in the art, and the incorporation of the firearm locking mechanism 10 of this invention into other semi-automatic pistols 12, handguns, rifles, or firearms having features or mechanisms which differ structurally or functionally from those described herein may be readily appreciated by those skilled in the art.

As used herein, the term "breech 28" is intended to refer, as appropriate from the context, either to: (1) the open or exposed region or area between the rear end of the barrel 30 or chamber and the breech block 36 or slide assembly 32, or (2) the rear face of the barrel 30 or chamber itself, which the breech block 36 contacts when in the closed position. As such, reference to the breech 28 being "open" or "exposed" indicates that the breech block 36 or slide assembly 32 is retracted rearwardly away from the rear end of the barrel 30 to expose the chamber and the internal area above the magazine 34 or clip, as well as portions of the firing pin assembly 38. In firearms other than a semi-automatic pistol 12, this might be accomplished by retracting the bolt in a bolt-action rifle, for example, or other similar procedures dependent upon the specific structure and operation of the firearm.

As used herein, the term magazine is intended to refer to a housing designed to hold a plurality of cartridges 26 or rounds of ammunition—either in a stacked, staggered, or helical drum configuration—that permits individual cartridges 26 to be stripped from the magazine 34 and chambered each time the firearm is cocked, fired, or otherwise operated in a manner intended to chamber a cartridge. It may be appreciated by those skilled in the art that certain firearms utilize a removable magazine 34, whereas others utilize a fixed or non-removable magazine 34 generally referred to as a clip. For purposes of this disclosure, unless otherwise specified, the general reference to a magazine 34 is intended to include any such magazine 34, clip, or similar housing for ammunition that operates as described and meets the requirements set forth herein for use with the firearm locking mechanism 10 of this invention.

Referring particularly to FIGS. 1–6, the firearm locking mechanism 10 is shown mounted or installed within the open breech 28 of the semi-automatic pistol 12 in which the slide assembly 32 has been fully retracted and held in place by the slide catch 44.

Referring to FIGS. 7–11, it may be seen that the firearm locking mechanism 10 includes a generally rectangular body 46 or block fabricated from a suitable light-weight metal or polymer such as carbon-fiber reinforced plastic, aluminum, or a steel alloy. The body 46 defines a generally cylindrical aperture 48 extending entirely therethrough into which a conventional pin-tumbler or cylindrical locking mechanism 50 is received and securely fastened. The locking mechanism 50 may, for example, be fastened using an expandable pin 54 or threaded hex bolt that is inserted through a smooth or matingly threaded bore 56 extending within the body 46 from the front face 58 of the body 46 to the aperture 48, the tip of the pin 54 projecting from the bore 56 into the aperture 48 and an aligned recess or aperture in the locking mechanism 50.

The locking mechanism 50 includes a keyway 60 for receiving a corresponding key 62 that permits the core 64 of the locking mechanism 50 to be rotated 90° relative to the body 46. The locking mechanism 50 may therefore be rotated between an unlocked position as shown in FIGS. 6–11, and a locked position as shown in FIGS. 2–5.

The locking mechanism 50 includes a foot or engagement member 66 fixedly attached to and depending from the bottom end of the core 64 and which is rotatable with the core 64. The engagement member 66 has a generally flat or planar bottom surface 68, a long and a short axis, and a pair of upwardly angled or tapered engagement surfaces 70 on opposing ends of the long axis of the engagement member 66. The upper surfaces of the engagement surfaces 70 may be convexly rounded to approximately the same radius as the cartridge 26 corresponding to the particular firearm with which the locking mechanism 10 is to be used.

Figure 12:
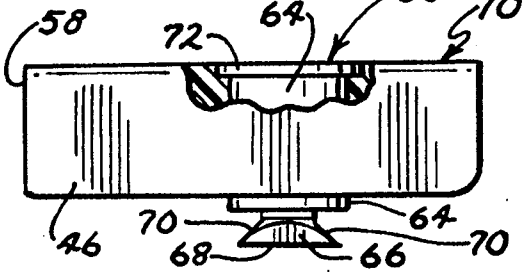
FIG. 12 is a side elevation view of an alternate embodiment the firearm locking mechanism of this invention.
Figure 10:
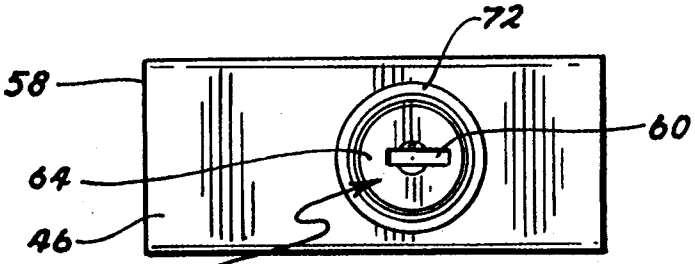
FIG. 10 is a top view of the firearm locking mechanism of FIG. 7.
Figure 7:
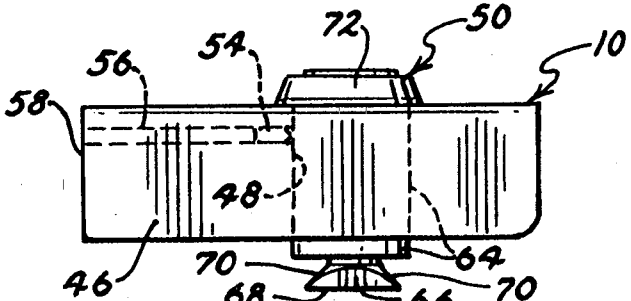
FIG. 7 is a side elevation view of the firearm locking mechanism of FIG. 1.
Figure 11:
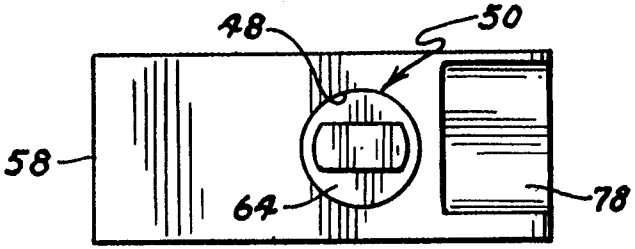
FIG. 11 is a bottom view of the firearm locking mechanism of FIG. 7.
Figure 9:
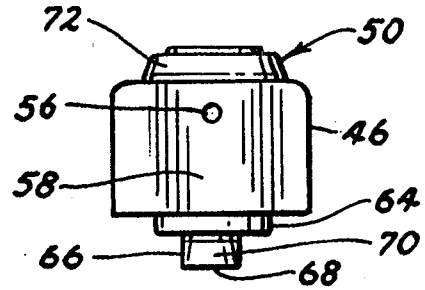
FIG. 9 is a front elevation view of the firearm locking mechanism of FIG. 7.

The locking mechanism 50 further includes an outwardly extending flange or collar 72 that projects radially from the core 64 sufficiently farther than the diameter of the aperture 48 to prevent the body 46 from being stripped over the top of the locking mechanism 50. Referring to FIG. 12, it may be seen that the flange or collar 72 and core 64 may be recessed within the body 46, particularly in instances where the body 46 is molded from a fiber-reinforced plastic resin or similar material. In such a case, it may be considered unnecessary to pin the locking mechanism 50 within the body 46 and instead use a force or pressure fit in which friction holds the locking mechanism 50 within the body 46. This may also be accomplished by close tolerances using a metal or alloy body 46. In some instances, it may be suitable to also utilize an expansion ring, collar, or one-way tab (not shown) projecting from the core 46 that engages in a groove or recess within the body 46 and secures the locking mechanism 50 within the body 46. Because the firearm locking mechanism 10 engages the magazine 34, it is not necessary in use that the locking mechanism 50 be permanently or irremovably attached to the body 46 but only attached securely enough that the locking mechanism 50 will not accidentally or inadvertently slide or be pulled out of the body 46 when the firearm locking mechanism 10 is not in use.

The magazine 34 generally includes one or a pair of cartridge-retaining members 74 disposed at the top of the magazine 34 to prevent the top cartridge 26 from being ejected from the magazine by spring pressure until the top cartridge 26 is forcibly stripped from the magazine 34 during the chainbering process. The cartridge-retaining members 74 generally define a gap or opening 76 through which the top cartridge 46 may be contacted.

The body 46 defines a recess 78 at the rear end which receives the exposed portions of the firing pin assembly 38. The recess 78 may be shaped in any manner suitable for the particular firearm with which the firearm locking mechanism 10 is utilized.

The body 46 of the firearm locking mechanism 10 as shown in the accompanying FIGS. 1–3 and 5–12 is generally rectangular in shape having top corners or edges that are slightly curved or radiused; however, it is preferred that the top surface of the body 46 be rounded or shaped to match the contour of the tops of the barrel 30 and slide assembly 32. In the present example, rounding the top of the body 46 to match the top surfaces of the barrel 30 and slide assembly 32 results in the reduction of the wall thickness surrounding the recess 78 to potentially unacceptable levels. It is anticipated that the recess 78 could be reduced in size while permitting the firing pin assembly 38 to be received therein and that similar configurations for other styles and models of firearms will not present such a problem when the top surface of the body 46 is rounded or shaped to match the contour of the firearm.

Figure 6:
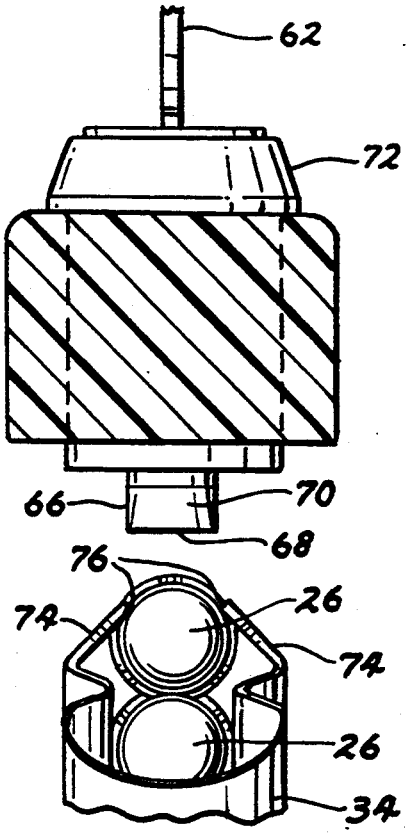
FIG. 6 is a partially broken away cross section view of the top of the magazine and firearm locking mechanism of FIG. 3 taken through line 5—5 of FIG. 3 showing the firearm locking mechanism disengaged from the magazine.
Figure 8:
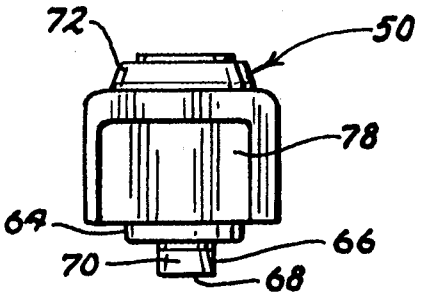
FIG. 8 is a rear elevation view of the firearm locking mechanism of FIG. 7.

In operation, the slide assembly 32 of the semi-automatic pistol 12 is retracted to completely open the breech 28, and the slide assembly 32 is held in the open position by the slide catch 44. The firearm locking mechanism 10 is disposed above the breech 28 as shown in phantom in FIG. 1, with the engagement member 66 oriented in an unlocked position so that the long axis is parallel with the opening 76 in the top of the magazine 34 and the top cartridge 26 if one is within the magazine 34 as shown in FIG. 6.

The body 46 of the firearm locking mechanism 10 is then inserted into the open or exposed breech 28 with the engagement member 66 passing through the opening 76 between the cartridge-retaining members 74 until the tapered engagement surfaces 70 of the engagement member 66 are disposed at a height or level below the cartridge-retaining members 74.

It may be readily appreciated that the magazine 34 may be loaded with several rounds of ammunition and still permit the firearm locking mechanism 10 to be installed on the firearm. For example, in a 9-shot magazine 34, the user would remove one cartridge 26 to permit sufficient clearance for the engagement member 66 of the firearm locking mechanism 10 to depress the remaining eight cartridges 26, and the bottom surface 68 of the engagement member would contact the top cartridge 26 and pivot thereon.

Clockwise or counter-clockwise rotation of the key 62 within the keyway 60 will rotate the core 64 and engagement member 66 to a locked position at which the long axis is oriented 90° perpendicular to the opening 76 in the top of the magazine 34, and the tapered engagement surfaces 70 of the engagement member 66 are disposed and engaged beneath the cartridge-retaining members 74 so that the locking mechanism 50 and body 46 of the firearm locking mechanism 10 are secured to the magazine 34 as shown particularly in FIGS. 2–5 and cannot be withdrawn or removed from the breech 28 unless the engagement member 66 is rotated back to its original unlocked position.

The key 62 may then be withdrawn from the keyway 60 of the firearm locking mechanism 10, and the firearm locking mechanism 10 will remain in the engaged and locked position and will prevent operation or discharge of the semi-automatic pistol 12 as well as removal of the magazine 34.

Rotating the key 62 and locking mechanism 50 to the unlocked position disengages the engagement member 66 from the cartridge-retaining members 74 of the magazine 34 and permits the locking mechanism 50 and body 46 to be withdrawn or removed from the open breech 28. In situations where the magazine 34 has a follower (not shown) that reaches the top of the magazine 34, or where one or more cartridges 26 are in the magazine 34 when the firearm locking mechanism 10 is installed, the spring pressure exerted upwardly on the bottom surface 68 of the engagement member 66 by the magazine spring (not shown) will assist the user in removing or withdrawing the body 46 of the firearm locking mechanism 10 from the open breech 28.

It may be appreciated that the locking mechanism 50 is preferably provided with a stop that restricts rotation of the locking mechanism to 90° so that over-rotation of the core 64 and engagement member 66 does not occur. Similarly, it may be desirable in some instances to utilize a locking mechanism in which the key 62 cannot be removed from the locking mechanism 50 when the key 62 and locking mechanism 50 are in the unlocked position, thereby permitting the key 62 to be used as a handle or gripping member to assist in removing the body 46 of the firearm locking mechanism 10 from the open breech 28 without the user shifting his or her grip, thereby enhancing the efficiency and safety of the firearm locking mechanism 10 for use in self-defense and emergency situations.

For the particular semi-automatic pistol 12 described herein, it has proven suitable to fabricate the firearm locking mechanism 10 having a body 46 with an overall length of $2\frac{3}{8}''$, a width of $1\frac{1}{8}''$, and a height of $\frac{3}{4}''$. The recess 78 has a height of approximately 9/16", a width of $\frac{7}{8}''$, and a depth from the rear face of the body 46 of $\frac{5}{8}''$, with the recess 78 having a left wall thickness of 1/16 " as viewed from the rear in FIG. 8 and a right wall thickness of 3/16". The center of rotation of the locking mechanism 50 is positioned approximately 1" from the rear face of the body 46 and centered left-to-right on the body 46. The core 64 and engagement member 66 projects approximately $\frac{5}{8}''$ from the bottom face of the body 46 measured to the bottom surface 68 of the engagement member 66, with the bottom surface of the engagement member having dimensions of 9/16" along the long axis (length) and 5/16" along the short axis (width) and the opposing ends of the engagement member 66 for the long axis being curved at approximately a 9/16" diameter. A cylindrical core 64 diameter of approximately 11/16" projecting $\frac{1}{8}''$ downwardly from the bottom face of the body 46 has proven suitable. A standard 5-pin pin tumbler locking mechanism 50 restricted to 90° arcuate motion and a $\frac{1}{8}''$ thick $\frac{7}{8}''$ diameter flange 72 has also proven suitable.

While the preferred embodiments of the above firearm locking mechanism 10 have been described in detail with reference to the attached drawing Figures, it is understood that various changes and adaptations may be made in the firearm locking mechanism 10 without departing from the spirit and scope of the appended claims.

What is claimed is:

1. A firearm locking mechanism for use with a firearm having a breech and a magazine, said magazine having an end disposed proximate to said breech, said end of said magazine being at least partially exposed when said breech is in an open position, said firearm locking mechanism comprising:

a body, at least a portion of said body being selectively disposed within the breech of the firearm when the breech is in the open position;

a locking mechanism, said locking mechanism being connected to said body and selectively movable between an unlocked position and a locked position; and an engagement member, said engagement member being operatively connected to said locking mechanism and disposed such that said engagement member engages the end of the magazine when said body is disposed within the breech of the firearm and said locking mechanism is in said locked position and such that said engagement member does not engage the end of the magazine when said locking mechanism is in said unlocked position, whereby the body blocks the breech in the open position and prevents the firearm from being discharged and the locking mechanism and engagement member prevent the body from being removed from the breech and the magazine from being removed from the firearm when the locking mechanism is in the locked position.

2. The firearm locking mechanism of claim 1 further comprising:

a key for actuating the locking mechanism, said key having an engaging portion configured so as to operatively mate with said locking mechanism, whereby the person may engage the key in the locking mechanism and selectively move the locking mechanism between the locked position and the unlocked position.

3. The firearm locking mechanism of claim 1 wherein the magazine has at least one cartridge-retaining member, the engagement member being disposed beneath said at least one cartridge-retaining member when the locking mechanism is in the locked position, whereby the engagement member contacts the at least one cartridge-retaining member and prevents removal of the magazine from the firearm.

4. The firearm locking mechanism of claim 1 wherein the magazine has at least one cartridge-retaining member, the engagement member being disposed beneath said at least one cartridge-retaining member when the locking mechanism is in the locked position, whereby the engagement member contacts the at least one cartridge-retaining member and prevents removal of the body from the breech of the firearm.

5. The firearm locking mechanism of claim 1 wherein the magazine is spring-biased such that pressure is normally exerted on a cartridge disposed within the magazine generally toward the end of the magazine engaged by the engagement member, whereby said pressure is exerted on the engagement member by said cartridge within the magazine.

6. The firearm locking mechanism of claim 5 wherein the pressure exerted on the engagement member by the cartridge within the magazine pushes the engagement member away from the end of the magazine when the locking mechanism is moved from the locked to the unlocked position.

7. The firearm locking mechanism of claim 5 wherein the pressure exerted on the engagement member by the cartridge within the magazine pushes the body out of the breech when the locking mechanism is moved from the locked to the unlocked position.

8. A method for selectively preventing the firing of a firearm by a person, said firearm having a breech and a magazine, said magazine having an end disposed proximate to said breech, said end of said magazine being at least partially exposed when said breech is in an open position, said method comprising the steps of:

positioning a body within the breech of the firearm when the breech of the firearm is in the open position, said body including a locking mechanism and an engagement member, said locking mechanism being connected to said body and selectively movable between an unlocked position and a locked position, said engagement member being operatively connected to said locking mechanism and disposed proximate to the end of the magazine; and selectively moving said locking mechanism to the locked position such that said engagement member engages the end of the magazine, whereby the body blocks the breech in the open position and prevents the firearm from being discharged, and the locking mechanism and engagement member prevent the body from being removed from the breech of the firearm and the magazine from being removed from the firearm.

9. The method of claim 8 further comprising the steps of:

selectively moving the locking mechanism to the unlocked position such that the engagement member does not engage the end of the magazine; and withdrawing the body from the breech of the firearm.

10. The method of claim 9 wherein the magazine is spring-biased such that pressure is exerted on a cartridge disposed within the magazine generally toward the end of the magazine and the step of withdrawing the body from the breech of the firearm is assisted by said pressure exerted on the engagement member by said cartridge within the magazine.

* * * * *